US009534617B2

(12) United States Patent
Meinhof

(10) Patent No.: US 9,534,617 B2
(45) Date of Patent: Jan. 3, 2017

(54) ELECTROPNEUMATIC POSITION REGULATOR

(75) Inventor: Andre-Heinrich Meinhof, Rheinstetten (DE)

(73) Assignee: Siemens Aktiengesellschaft, Munich (DE)

( * ) Notice: Subject to any disclaimer, the term of this patent is extended or adjusted under 35 U.S.C. 154(b) by 697 days.

(21) Appl. No.: 14/112,168

(22) PCT Filed: Apr. 11, 2012

(86) PCT No.: PCT/EP2012/056498

§ 371 (c)(1),
(2), (4) Date: Nov. 14, 2013

(87) PCT Pub. No.: WO2012/143265

PCT Pub. Date: Oct. 26, 2012

(65) Prior Publication Data

US 2014/0060029 A1 Mar. 6, 2014

(30) Foreign Application Priority Data

Apr. 18, 2011 (DE) ..... 10 2011 007 629

(51) Int. Cl.
*F15B 20/00* (2006.01)
*F15B 19/00* (2006.01)

(52) U.S. Cl.
CPC ..... *F15B 20/005* (2013.01); *F15B 19/005* (2013.01); *F15B 2211/30575* (2013.01);
(Continued)

(58) Field of Classification Search
CPC ..... F15B 20/005; F15B 19/005; F15B 2211/6306;F15B 2211/8752; F15B 2211/87; F15B 2211/8855
See application file for complete search history.

(56) References Cited

U.S. PATENT DOCUMENTS 4,852,850 A * 8/1989 Wilhelm ..... F01D 17/26 251/28
4,901,751 A * 2/1990 Story ..... F16K 37/00 137/312

(Continued)

FOREIGN PATENT DOCUMENTS

| | | |
|---|---|---|
| DE | 4239431 | 7/1993 |
| DE | 19636418 | 6/1998 |
| DE | 102004048689 | 10/2005 |

*Primary Examiner* — Eric Keasel
(74) *Attorney, Agent, or Firm* — Cozen O'Connor

(57) ABSTRACT

The invention relates to an electropneumatic position controller having a controllable valve group (9, 10, 13) arranged in the position controller and having at least one valve (9, 10), by means of which in normal operation either compressed air supplied by means of a compressed air supply line (6) can be fed to an exhaust connection (8) or air fed by means of the exhaust connection (8) can be discharged to the outside, depending on the actuation of the valve group. In order for the valve group to be brought in a safe position, even in the event of a leak in one of the components thereof, said group is arranged in a gas-tight housing (14) within the position controller and means (15) are provided for monitoring the pressure in the housing (14) and for actuating the valve group (9, 10, 13) such that if the pressure in the housing (14) exceeds a predefined threshold value, said group is brought in the predefined safe position.

4 Claims, 1 Drawing Sheet

(52) U.S. Cl.
CPC ... *F15B 2211/6306* (2013.01); *F15B 2211/87* (2013.01); *F15B 2211/8752* (2013.01); *F15B 2211/8855* (2013.01)

(56) References Cited

U.S. PATENT DOCUMENTS

| | | | | | |
|---|---|---|---|---|---|
| 5,251,653 | A * | 10/1993 | Tucker | F16K 17/20 | 137/487.5 |
| 5,709,239 | A * | 1/1998 | Macalello | F16K 17/32 | 137/10 |
| 6,310,283 | B1 * | 10/2001 | Lichtenberg | B60T 8/362 | 137/596.16 |
| 6,954,683 | B2 * | 10/2005 | Junk | F15B 13/0402 | 700/272 |
| 7,124,057 | B2 * | 10/2006 | Forster | F15B 19/005 | 702/182 |
| 7,322,270 | B2 * | 1/2008 | Schmieding | F15B 20/008 | 60/657 |
| 7,757,714 | B2 | 7/2010 | Meinhof | | |
| 8,262,060 | B2 * | 9/2012 | Heer | G05B 23/0256 | 137/554 |
| 8,313,083 | B2 * | 11/2012 | Tabelander | F15B 19/005 | 137/557 |
| 8,316,695 | B2 * | 11/2012 | Jarvie | G01M 3/2892 | 137/398 |
| 8,579,252 | B2 * | 11/2013 | Heer | F15B 20/002 | 137/487.5 |
| 2003/0208305 | A1 | 11/2003 | Junk et al. | | |

* cited by examiner

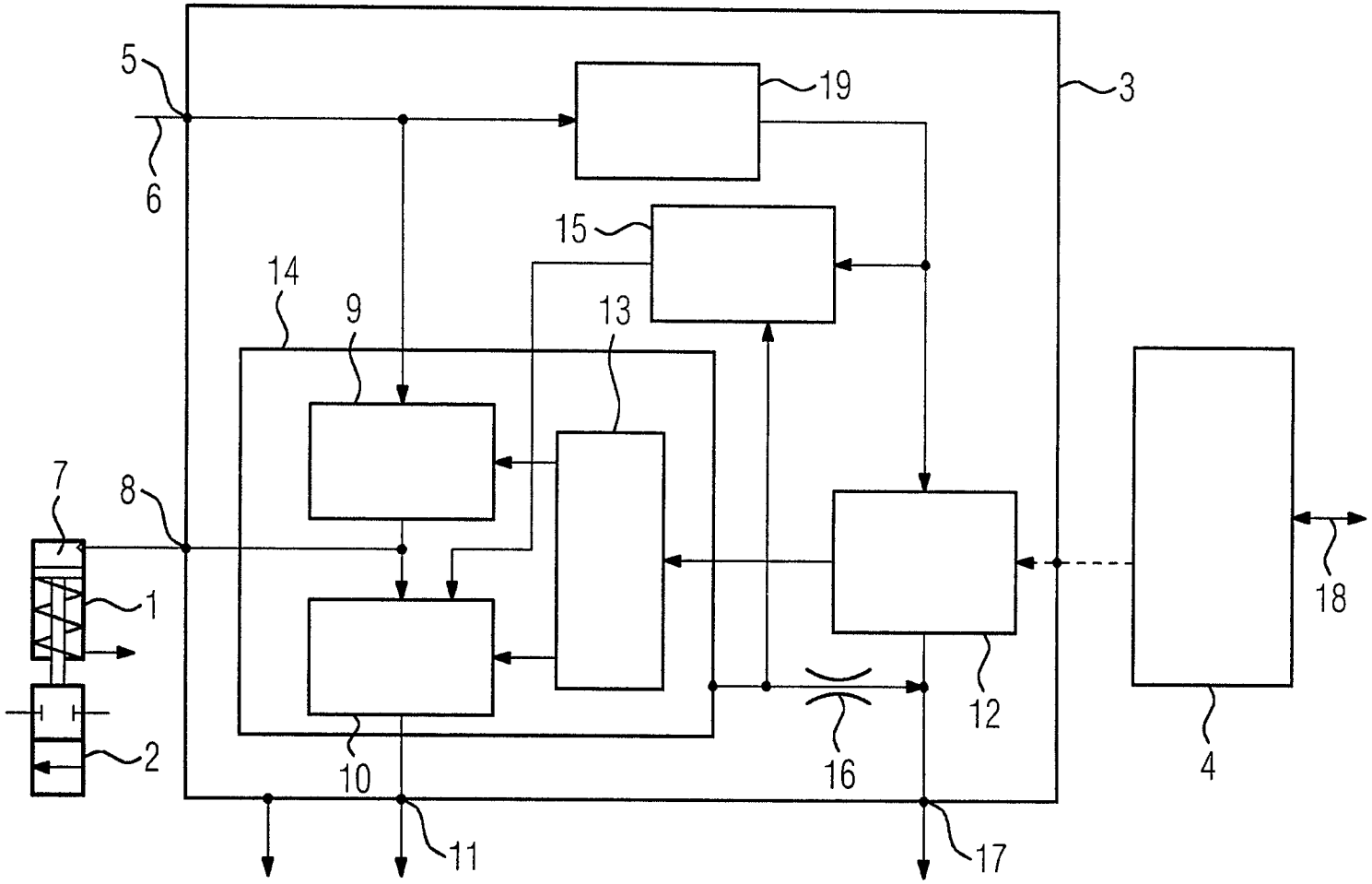
18
4
3
12
17
16
19
15
13
11
9
10
14
5
6
8
1
2
7

ELECTROPNEUMATIC POSITION REGULATOR

CROSS-REFERENCE TO RELATED APPLICATIONS

This is a U.S. national stage of application No. PCT/EP2012/056498 filed 11 Apr. 2012. Priority is claimed on German Application No. 10 2011 007 629.8 filed 18 Apr. 2011, the content of which is incorporated herein by reference in its entirety.

BACKGROUND OF THE INVENTION

1.Field of the Invention

The invention relates to an electropneumatic position regulator having a feed air port for connection to a compressed-air supply line, at least one exit air port for connection to a pneumatic drive of a servo unit, and a controllable valve group arranged in the electropneumatic position regulator.

2. Description of the Related Art

For the control of process valves, use is commonly made of pneumatic servo drives as servo units, in which a diaphragm that acts on a servo element, such as a lifting rod connected to a closing body, is acted on with a variable pressure, for the purpose of generating movements, via a gaseous medium that will hereinafter be referred to in general terms as "air". The pressurization may occur on one side, where the diaphragm is subjected to a load on the other side by a spring, or on two sides, and where different pressures on the two sides of the diaphragm cause the deflection. The regulation of the one or more pressures is realized by an electropneumatic position regulator, in which at least one actuable valve, depending on the actuation thereof, distributes pressurized feed air via one or two exit air ports to one or both sides of the diaphragm in the servo drive.

DE 10 2004 048 689 B3 discloses a two-stage pilot-control valve for use in an electropneumatic position regulator. In a first stage, four flow resistances, of which at least one flow resistance is variable, are arranged in a bridge circuit. Two opposite circuit points in the bridge circuit are connected to feed air, and to exit air passing to the environment, respectively. Between the two other circuit points, a pressure difference is provided that is variable in magnitude and sign and which serves as a pneumatic output signal of the electropneumatic transducer, which is thus realized in the first stage, for actuation of the downstream second stage. In the second stage there is situated a valve group that has a control piston that can be operated by the pressure difference. The control piston serves to operate a pneumatic valve in the valve group, via which pneumatic valve, depending on the actuation thereof, either compressed air supplied via the feed air line is conducted to the exit air port to the servo drive, or air supplied via the same exit air port is discharged to the outside. The pneumatic drive of a regulating valve, for example, is connected to the exit air port. In the event of failure of the pneumatic energy (i.e., compressed air), it is often necessary for the drive actuated by the position regulator to automatically place the process valves into a safe position, i.e., a position that is safe in the surroundings of the respective process, generally "open" or "closed".

It is increasingly also the case that, in the event of other faults in electropneumatic position regulators, within the context of functional safety, which is classified in safety requirement steps or by "Safety Integrity Level" (SIL), it is required that the predefined safe position be attained in as safe a manner as possible. Specifically, in a fault assessment, a distinction can be made between dangerous faults, in the case of which the safe position can no longer be assumed as a result of the fault or in response to a demand, and non-dangerous faults, in the case of which the appliance is duly no longer functional but is placed into the predefined safe position. It has hitherto commonly been possible for material wear in valves of the valve group, in particular wear of the seals or diaphragms commonly used in valves, to lead to dangerous faults in electropneumatic position regulators.

DE 42 39 431 A1 discloses a position regulator and a servo element having a position regulator of said type. For monitoring, if the servo element has a seal, in particular a slide seal, a leakage chamber is provided on that side of the seal which is remote from the pressure, which leakage chamber is connected to a pressure switch which, if a set pressure is exceeded, generates a signal output to the position regulator. As a seal, use is made in particular of the bushing that is commonly provided in regulating valves. By means of the pressure switch, is possible to monitor whether a pressure that lies above the admissible pressure is generated in the leakage chamber owing to leakage. The signal output may be used for generating an alarm signal or for performing a safety routine.

SUMMARY OF THE INVENTION

It is the object of the invention to provide an electropneumatic position regulator which has increased functional safety.

This and other objects and advantages are achieved in accordance with the invention by providing an electropneumatic position regulator in which a significantly greater number of possibly occurring faults are advantageously classified as non-dangerous faults. The ratio between dangerous faults and non-dangerous faults is thus considerably improved.

The electropneumatic position regulator in accordance with the invention is based on the realization that material wear on seals or diaphragms that are used in valves of a valve group is usually initially manifested as compressed-air leakage at the valves. If the valves are accommodated in a gas-tight housing, this leads to a pressure increase within the housing. If a gradual or sudden leakage occurs, such as in the event of the rupture of a diaphragm, within the housing, then the pressure increase that is generated in the process is detected by a pressure monitor that interacts with the valves of the valve group and actuates these valves such that the valve group is placed into a predefined safe position.

Valve assemblies in electropneumatic position regulators are normally accommodated in a separate housing in any case. Consequently, the invention involves only a small amount of additional outlay. Specifically, it is merely necessary for the existing housing to be supplemented by a suitable housing seal.

In principle, the pressure monitor, and the actuation of the valve group to place the valve group into a safe position in the event of an excessively high housing internal pressure, may be realized electronically or electromechanically, such as by a pressure sensor with electromagnets connected downstream. It is however preferable for the pressure monitor and actuation to be implemented exclusively pneumatically, such that it is advantageously the case that no electrical auxiliary energy whatsoever is required for the implementation thereof. In particular, in the case of field devices in the area of process instrumentation, which are operated with a 4 to 20 mA interface, there is only a limited availability of such electrical auxiliary energy. Furthermore, in the case of such an implementation, the safe position can be assumed entirely independently of the operability of the electronics of the electropneumatic position regulator, thus further increasing functional safety.

A small amount of leakage up to a certain threshold is admissible without impairment of operation. As a result, it is possible in one particularly advantageous embodiment of the invention for an aperture to be provided for ventilating the housing with a predetermined maximum air throughflow. The housing interior is then connected to the surroundings of the electro-pneumatic position regulator via the aperture as a flow resistance. In one exemplary embodiment, the aperture may be dimensioned such that an air throughflow of 1 liter per minute leads to a pressure increase of 0.8 bar in the housing interior, at which the pressure monitor responds and places the valve group into a safe position.

In an embodiment of an electropneumatic position regulator in which an electropneumatic transducer is connected upstream of the valve group, the exit air side of the aperture is preferably connected to the exit air outlet of the transducer. This has the advantage that, aside from monitoring the valve group with regard to adherence to an admissible level of leakage, the exit air outlet of the electropneumatic transducer is also checked with regard to free throughflow capability, because a blockage of the outlet, such as owing to icing or fouling of the outlet opening, leads to an increase of the housing internal pressure even in the event of a small leakage, with the valve group thus being placed into the safe position even in the case of this fault. It is thus also possible for a closure of the outlet of the electropneumatic transducer to be classified as a non-dangerous fault, which closure could otherwise lead to the actuation of the valve group being rendered ineffective, and thus to a dangerous fault of the position regulator.

In another advantageous embodiment of the invention, the position of the valve group can be detected by regulator electronics that are commonly provided in electropneumatic position regulators, such that the regulator electronics output a signal for displaying a fault state, such as in the form of an alarm signal via a field bus, if the valve group is in the safe position but this state does not correspond to the actuation of the valve group by the regulator electronics and by an electropneumatic transducer that may be connected downstream thereof. In an automation unit or a control station as a receiver of the alarm, the alarm can be processed further and output to an operator, such that the operator can initiate maintenance work or other suitable actions for dealing with the signaled fault state.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWING

The invention and embodiments and advantages will be explained below on the basis of the drawing, which illustrates an exemplary embodiment of the invention.

The FIGURE is a schematic block diagram of an electropneumatic position regulator in accordance with the invention.

DETAILED DESCRIPTION OF THE PREFERRED EMBODIMENTS

The FIGURE shows only those parts of an electropneumatic position regulator that contribute to the understanding of the invention, and also shows a pneumatic drive 1, connected to the electropneumatic position regulator, for a servo unit 2, in this case a process valve. The pneumatic position regulator has a pilot-control valve 3 and regulator electronics 4. A feed air port 5 serves for connection of a compressed-air supply line 6 via which, for example, compressed air is supplied at 6 bar pressure to the pilot-control valve 3. The upper chamber 7 of the drive 1 is connected to an exit air port 8 of the pilot-control valve. Depending on actuation, it is either the case that compressed air is conducted from the compressed-air supply line 6 to the chamber 7 by a feed air valve 9, or the compressed air is discharged from the pressure chamber 7 via a valve outlet 11 into the environment by an exit air valve 10. By means of a suitable locking mechanism which, for clarity, is not illustrated in the FIGURE, it is ensured that the two valves 9 and 10 are never simultaneously open, because otherwise compressed air could escape, unused, into the environment. The regulation of the position of the servo unit 2 by the pressure set in the pressure chamber 7 of the drive 1 is performed by the regulator electronics 4, an electropneumatic transducer 12 which, in a known manner, is in the form of a bridge circuit of flow resistances, and a booster drive 13 for operating the feed air valve 9 and the exit air valve 10 in accordance with the pressure difference set with the aid of the electropneumatic transducer 12.

By means of a pressure regulator 19, the supply pressure of, for example, 6 bar is reduced to a regulated pressure of, such as 1.4 bar, which prevails at the bridge circuit of the electropneumatic transducer 12.

A valve group of the electropneumatic position regulator, which valve group is composed, in the exemplary embodiment shown, of the feed air valve 9, the exit air valve 10 and the booster drive 13, is arranged in a gas-tight housing 14 within the position regulator. By means of a pressure monitor 15, the pressure prevailing within the housing 14 is monitored with regard to adherence to a predetermined threshold value of, for example 0.8 bar. All free interior spaces within the gas-tight housing 14, the regions opposite the pressure chambers of the booster drive 13, the region around the valves 9 and 10, spring chambers situated in the valve group and the region around the locking device of the valves 9 and 10 are pneumatically connected to one another. If leakage occurs in the valve group, such as if a crack forms in a diaphragm of the booster drive 13, compressed air escapes through the leak into the gas-tight interior of the housing 14 and leads to a pressure increase that is detected by the pressure monitor 15. As long as the pressure does not exceed a threshold value of 0.8 bar, the pressure monitor 15 does not intervene in the regulation of the position of the servo unit 2. However, if the pressure rises above the threshold value, the pressure monitor 15 opens the exit air valve 10. By means of the locking device not illustrated in the FIGURE, the feed air valve is simultaneously closed, such that the pressure in the pressure chamber 7 of the drive 1 rapidly drops and the servo unit 2 is placed into the safe position, which in the exemplary embodiment shown corresponds to an "opening" of the process valve. The valve group switching state required for this purpose is likewise referred to as a safe position.

By contrast to the exemplary embodiment described, it is self-evidently possible in an alternative embodiment for the process valve to be arranged such that it "closes" in the event of a pressure drop in the chamber 7. In a further modification of the exemplary embodiment, additional components, such as the electropneumatic transducer 12, the pressure regulator 19 and/or the pressure monitor 15, can additionally be integrated into the housing 14.

Small leakages at the valve group in the housing 14 need not imperatively lead to malfunctions. To prevent the safe position of the servo unit 2 being assumed even in the case of small leakages, an aperture 16 is provided that can also be referred to as a throttle or flow resistance and that is connected between the interior of the housing 14 and an exit air outlet 17 of the electropneumatic transducer 12. The aperture 16 is, for example, set such that a leakage of one liter per minute leads to a pressure increase of 0.8 bar in the housing 14. The pressure monitor 15 thus first responds if the airflow through the throttle 16 exceeds one liter per minute or if the exit air outlet 17 of the transducer 12 is blocked, for example, owing to icing or fouling.

For performing the regulation, the present position of the valves 9 and 10 is taken into consideration in the regulator electronics 4. To identify a response of the pressure monitor 15 and a resulting assumption of the safe position by the valve group with the valves 9 and 10, it is additionally checked in the regulator electronics 4 as to whether the position of the feed air valve 9 and of the exit air valve 10 corresponds to the position predefined by the regulator electronics 4 by the electropneumatic transducer 12. A lack of correspondence, in the event of the safe position simultaneously being assumed by the valve group, is evaluated by the regulator electronics 4 as a fault state. This generates a corresponding alarm signal which, for example, via a field bus 18 by which the electropneumatic position regulator is connected into an automation network or an automation-oriented system, is output, for example, to a superordinate control station such that, in reaction to the fault that has occurred, suitable measures for eliminating the fault can be initiated.

Thus, while there have shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An electropneumatic position regulator comprising:

a feed air port for connection of a compressed-air supply line;

at least one exit air port for connection of a pneumatic drive of a servo unit;

a gas-tight housing;

a controllable valve group arranged in the position regulator and which includes at least one valve, via which valve group, during normal operation and depending on an actuation of the controllable valve group, one of (i) compressed air supplied via the compressed-air supply line is conductable to the at least one exit air port and (ii) air supplied via the at least one exit air port is dischargeable to an outside, the controllable valve group being arranged within the gas-tight housing;

a pressure monitor for monitoring a pressure prevailing in the gas-tight housing and for actuating the controllable valve group such that the controllable valve group is placed into a predefined safe position if the prevailing pressure in the gas-tight housing exceeds a predetermined threshold value; and an aperture for ventilating the gas-tight housing with a predetermined maximum throughflow.

2. The electropneumatic position regulator as claimed in claim 1, wherein the pressure monitor pneumatically actuates the controllable valve group.

3. The electropneumatic position regulator as claimed in claim 2, further comprising:

an electropneumatic transducer connected upstream of the valve group, an exit air side of the aperture being connected to an exit air outlet of the electropneumatic transducer.

4. The electropneumatic position regulator as claimed in claim 1, wherein a position of the controllable valve group is detectable by regulator electronics; and wherein the regulator electronics are configured to output a signal for displaying a fault state if the controllable valve group is in a safe position which does not correspond to actuation of the controllable valve group by the regulator electronics.

* * * * *